US006976435B2

(12) United States Patent
Lucas et al.

(10) Patent No.: US 6,976,435 B2
(45) Date of Patent: Dec. 20, 2005

(54) DISPOSABLE/RECYCLABLE PALLET SYSTEM AND METHOD

(75) Inventors: Philip J. Lucas, Golden, CO (US); William P. Apps, Alpharetta, GA (US); Jon P. Hassell, Atlanta, GA (US)

(73) Assignee: Coors Global Properties, Inc., Lakewood, CO (US)

( * ) Notice: Subject to any disclaimer, the term of this patent is extended or adjusted under 35 U.S.C. 154(b) by 27 days.

(21) Appl. No.: 10/838,934

(22) Filed: May 3, 2004

(65) Prior Publication Data

US 2004/0208739 A1 Oct. 21, 2004

Related U.S. Application Data

(63) Continuation of application No. 10/272,030, filed on Oct. 15, 2002, now abandoned.

(51) Int. Cl.[7] ..... B65D 19/12

(52) U.S. Cl. ..... 108/51.11; 108/57.12; 108/64; 248/346.01; 248/346.03; 248/316.06

(58) Field of Search ..... 108/51.11, 57.12, 108/57.25, 57.26, 57.28, 57.29, 64, 180, 108/156, 153.1; 248/599, 601, 612, 615, 248/346.01, 346.03, 346.06; 206/433, 511, 206/521, 586; 414/799, 800

(56) References Cited

U.S. PATENT DOCUMENTS 3,101,063 A * 8/1963 Wharton ..... 108/57.12
3,267,882 A * 8/1966 Rapson et al. ..... 108/51.11
3,351,027 A * 11/1967 Ellard, Jr. et al ..... 108/57.12
3,440,976 A * 4/1969 Burne ..... 108/51.11
3,828,965 A * 8/1974 Yarbrough ..... 220/1.5
3,857,342 A * 12/1974 Johns ..... 108/53.3
3,999,661 A * 12/1976 Jones ..... 206/591
4,013,021 A * 3/1977 Steinlein et al. ..... 108/57.25
4,051,787 A * 10/1977 Nishitani et al. ..... 108/55.3
4,241,830 A * 12/1980 Di Gesu' ..... 206/422
4,323,016 A * 4/1982 Flesher et al. ..... 108/57.14
4,509,433 A * 4/1985 Farr ..... 108/52.1
4,550,830 A * 11/1985 Shuert ..... 206/386
4,562,718 A * 1/1986 Dunk ..... 72/349
4,838,419 A * 6/1989 Weits et al. ..... 206/386
4,887,537 A * 12/1989 Kellogg ..... 108/55.1
5,105,746 A * 4/1992 Reynolds ..... 108/56.1
5,191,843 A * 3/1993 Ausavich et al. ..... 108/56.3
5,193,700 A * 3/1993 Lyman et al. ..... 220/1.5
5,197,395 A * 3/1993 Pigott et al. ..... 108/56.1
5,388,533 A * 2/1995 Pigott et al. ..... 108/56.3
5,404,829 A * 4/1995 Shuert ..... 108/57.26
5,433,156 A * 7/1995 Hutchison ..... 108/51.3
5,461,988 A * 10/1995 Cummings et al. ..... 108/51.3

(Continued)

*Primary Examiner*—Douglas Hess
(74) *Attorney, Agent, or Firm*—Klaas, Law, O'Meara & Malkin, P.C.; William P. O'Meara; Nellie C. Kaufman

(57) ABSTRACT

A pallet system for supporting a load of packages is disclosed. The pallet system is comprised of a plurality of pallet units. Each pallet unit may have a load support portion, a plurality of side portions attached thereto, and a flange portion attached to the side portions. The load support portion is adapted to be placed directly adjacent to the bottom surface of the load. The side portions have openings sufficiently sized to receive forks of a forklift. The flange portion is flexible and extends continuously around the periphery of the pallet unit. A method for supporting a load of packages utilizing a plurality of pallet units is also disclosed.

14 Claims, 6 Drawing Sheets

U.S. PATENT DOCUMENTS 5,603,266 A * 2/1997 Nash ..... 108/56.3
5,960,720 A * 10/1999 Borland et al. ..... 108/53.1
6,112,672 A * 9/2000 Heil ..... 108/55.3
6,186,468 B1 * 2/2001 Schlegel ..... 248/678
6,199,487 B1 * 3/2001 Coddington ..... 108/56.1
6,508,182 B1 * 1/2003 Smorgan et al. ..... 108/57.28
6,644,218 B2 * 11/2003 Gruber ..... 108/57.12
6,668,734 B2 * 12/2003 Lucas et al. ..... 108/51.11

* cited by examiner

DISPOSABLE/RECYCLABLE PALLET SYSTEM AND METHOD

CROSS-REFERENCE TO RELATED APPLICATION

The present application is a continuation of co-pending U.S. patent application Ser. No. 10/272,030 filed Oct. 15, 2002 now abandoned for DISPOSABLE/RE-CYCLABLE PALLET SYSTEM AND METHOD of Philip J. Lucas, which is hereby specifically incorporated by reference for all that is disclosed therein.

FIELD OF THE INVENTION

The present invention relates generally to pallets used to support and transport a load of packages, and, in particular, to disposable and/or recyclable pallet systems and methods for supporting a load of packages.

BACKGROUND OF THE INVENTION

Pallets are typically used to support a load of packages, allowing the load to be lifted and transported by lifting equipment such as a forklift or floor jack. Several layers of packages may be loaded onto a pallet, and the load may then be secured around its circumference using, for example, flexible wrap or shrink-wrap in order to stabilize the load on the pallet.

Some pallets have a platform upon which the packages are loaded and a base having channels adapted to receive the "forks" of a conventional forklift or floor jack. These pallets, hereinafter referred to as "platform-type pallets", are typically constructed from wood or plastic, and may be re-used multiple times. Disadvantages to using plafform-type pallets involve the cost of producing the pallet, space required for and cost of storing the pallets, cost of shipping the pallet and its load to their destination, and cost and inconvenience of shipping the pallet back from its destination so it may be reused. The shipping costs are even more significant for relatively heavier pallets (e.g., wood pallets). Due to weight restrictions, the amount of product that can be shipped with the relatively heavier pallets is reduced. Furthermore, while these pallets are generally reusable, they are subject to breakage (especially wood pallets).

A relatively thin and lightweight alternative to a platform-type pallet is known as a "slip sheet" or "slip pallet". Referring to FIG. 1, a conventional slip pallet 10 may be, for example, a thin sheet of lightweight material such as plastic having one or more extending edges 12. The slip pallet 10 is loaded with packages 20 and the packages are usually wrapped around the circumference of the load (i.e., around a vertical axis) in order to stabilize the load 22. A specially adapted lift truck 24 grasps an edge, e.g. 12, of the slip pallet 10, pulls the slip pallet 10 onto a platform 26, and then lifts and transports the load 22 as desired. As the load 22 is lifted and transferred onto the platform 26, the weight of the load 22 shifts from the leading end 14 to the opposite (trailing) end 16 (as indicated by "L1" and "L2"), possibly damaging packages (e.g., 20*a*, 20*b*) located on the lowermost layers 18 on these ends 14, 16. The greater the lift angle "A1", the greater the weight "L2" exerted on the packages (e.g., 20*b*) located on the trailing end 16 of the load 22, especially those on the lowermost layers 18.

Furthermore, using either a platform-type pallet or a slip pallet, additional damage may occur to the lowermost layers of packages during shipping due to vibration and jostling of the load.

SUMMARY OF THE INVENTION

The present invention directed to a pallet system for supporting a load of packages. The pallet system is comprised of a plurality of pallet units, each having a load support portion, a plurality of side portions attached thereto, and a flange portion attached to the side portions. The upper surface of the load support portion may be placed directly adjacent to and contact the bottom surface of the load. Each of the side portions has at least one opening which is sufficiently sized to receive a fork of a forklift. The flange portion is flexible and extends continuously around the periphery of the pallet unit.

The present invention is also directed to a method for supporting a load of packages. The method includes the steps of aligning a plurality of pallet units relative to one another and then placing a plurality of packages directly adjacent to the load support portion of the pallet units to form the load, such that the load support portion contacts the bottom surface of the load.

BRIEF DESCRIPTION OF THE DRAWINGS

Illustrative and presently preferred embodiments of the invention are illustrated in the drawings in which.

DETAILED DESCRIPTION OF THE PREFERRED EMBODIMENTS

Figure 1:
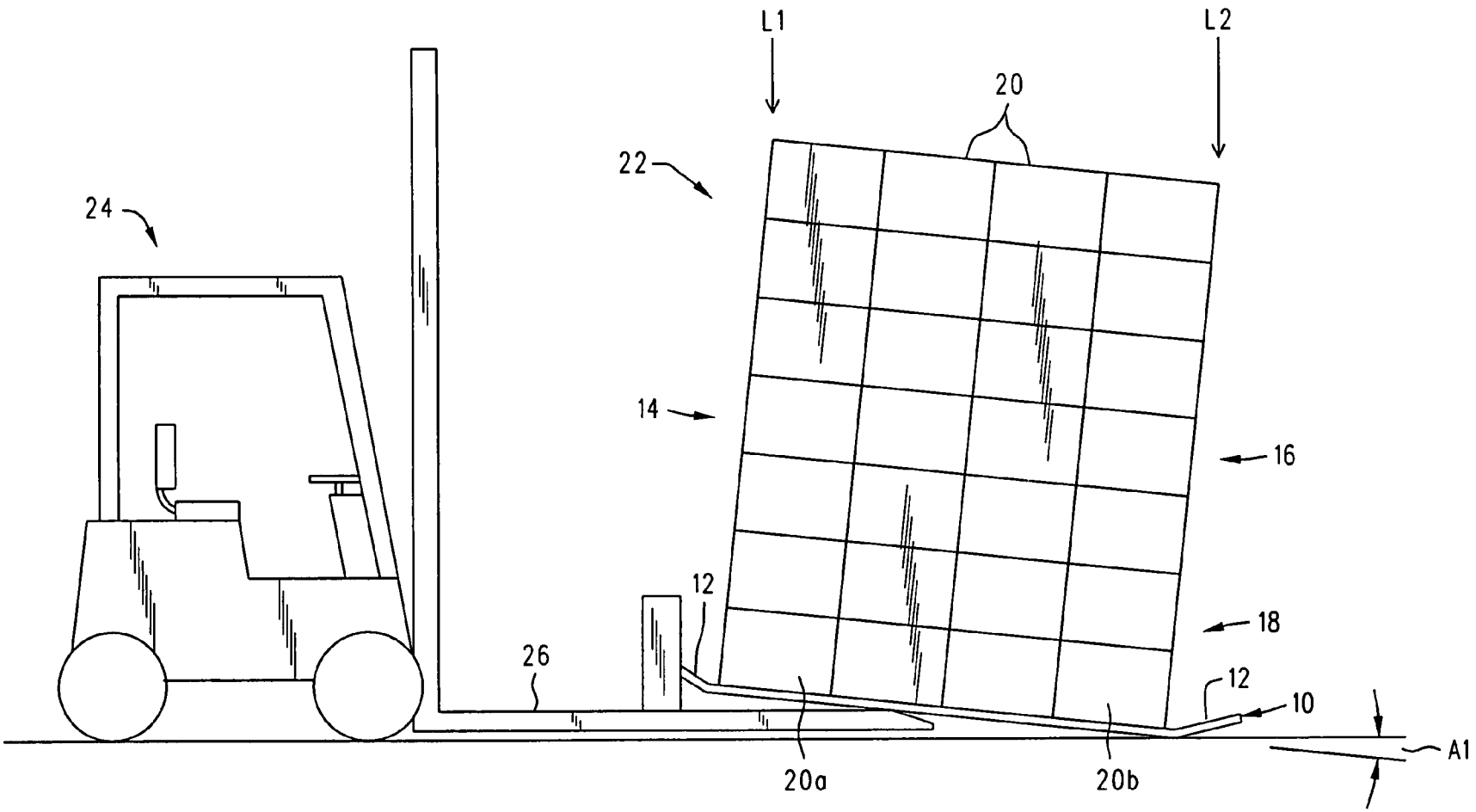
FIG. 1 (PRIOR ART)
FIG. 1 is a side elevation view of a lift truck manipulating a load on a conventional slip pallet.
Figure 2:
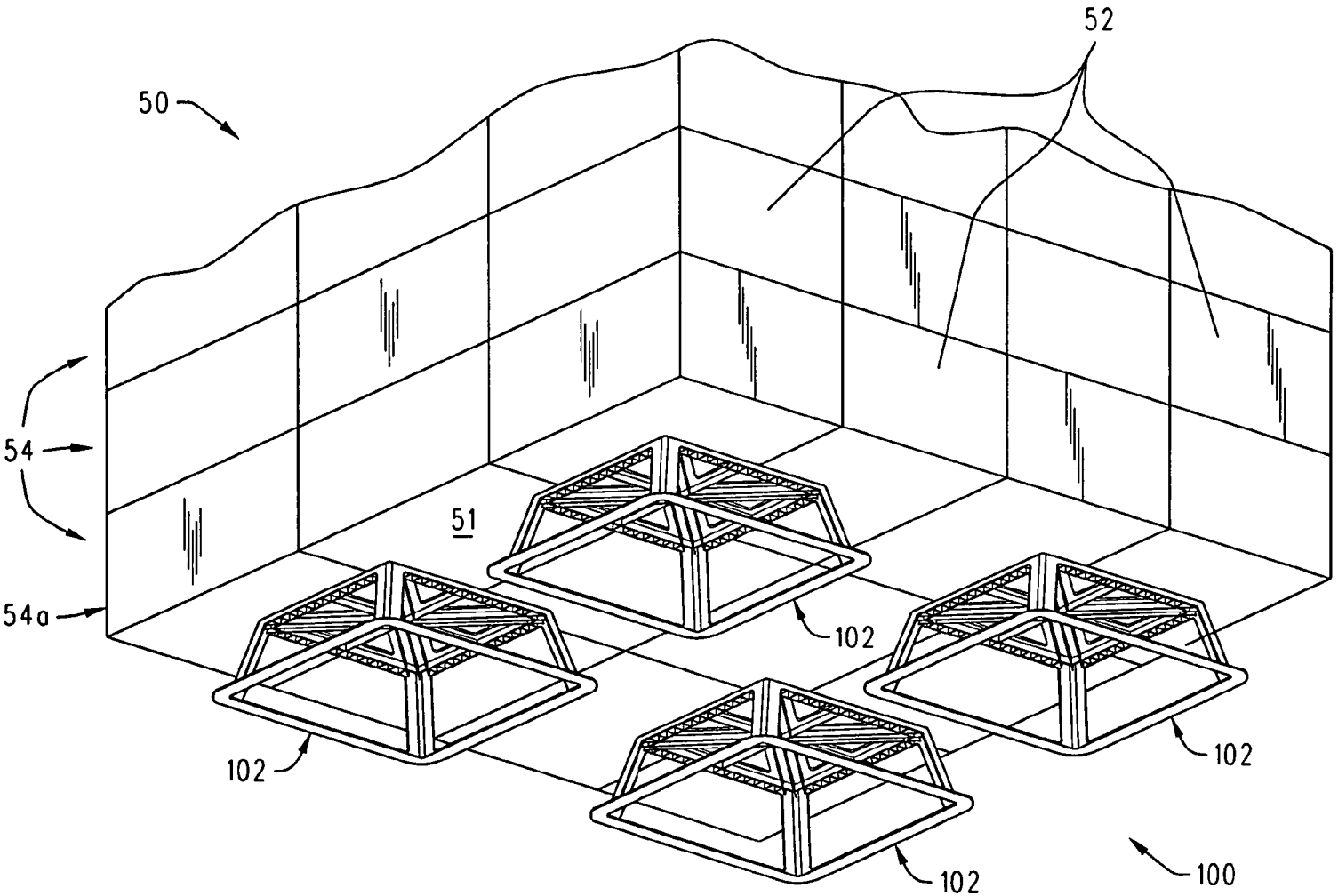
FIG. 2 is a perspective view of a load on the pallet system of the present invention.

As shown in FIG. 2, the pallet system 100 of the present invention is adapted to support a load 50 of packages 52, allowing the load to be lifted and transported by a conventional lift truck such as a forklift (not shown). A typical load 50 (only a portion of which is illustrated in FIG. 2) is comprised of several layers 54, including a lowermost layer 54*a*. The packages 52 may be, for example, substantially rectangular-shaped cartons as shown in the drawings. However, these packages 52 are merely exemplary, and it is to be understood that the pallet system 100 of the present invention may be adapted to support other types of packages. Furthermore, the size and configuration of the load 50 shown is also merely exemplary, and the pallet system 100 of the present invention may be adapted to support other load configurations. For example, several loads 50 and pallet systems 100 may be stacked on top of one another, and the lowermost pallet system 100 may be adapted to support all of the other loads 50 and pallet systems 100 stacked thereon.

As shown in FIG. 2, the pallet system 100 may comprise a plurality of pallet units 102 which may be substantially identical to one another. The pallet units 102 may also be stackable for ease of storage when not supporting a load 50.

Figure 3:
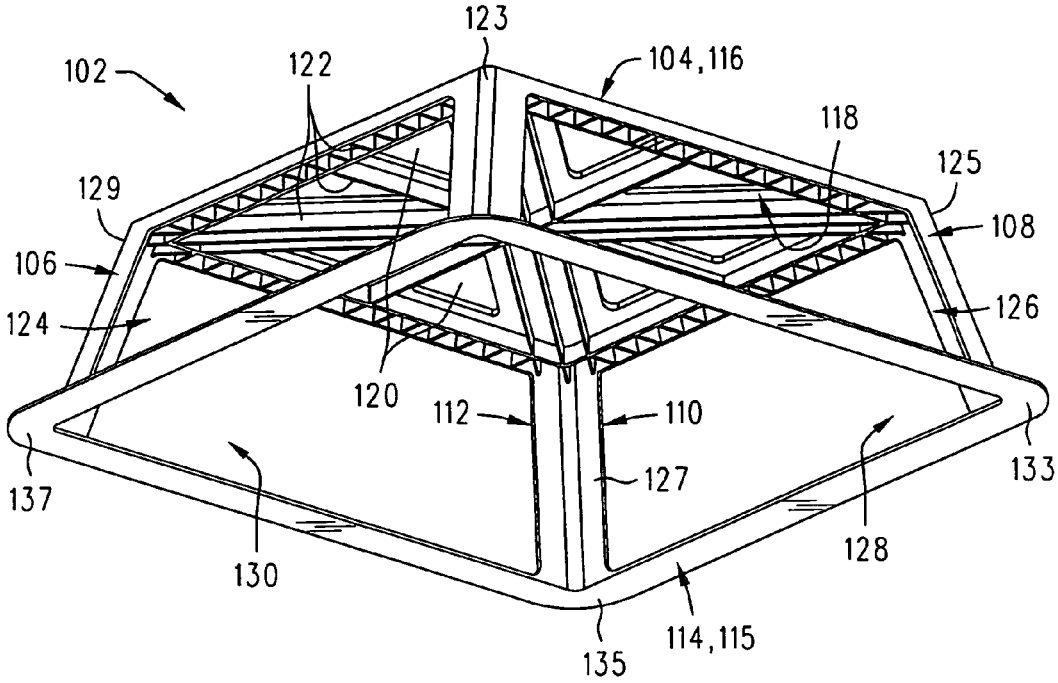
FIG. 3 is a perspective view of a pallet unit from the pallet system of FIG. 2.
Figure 4:
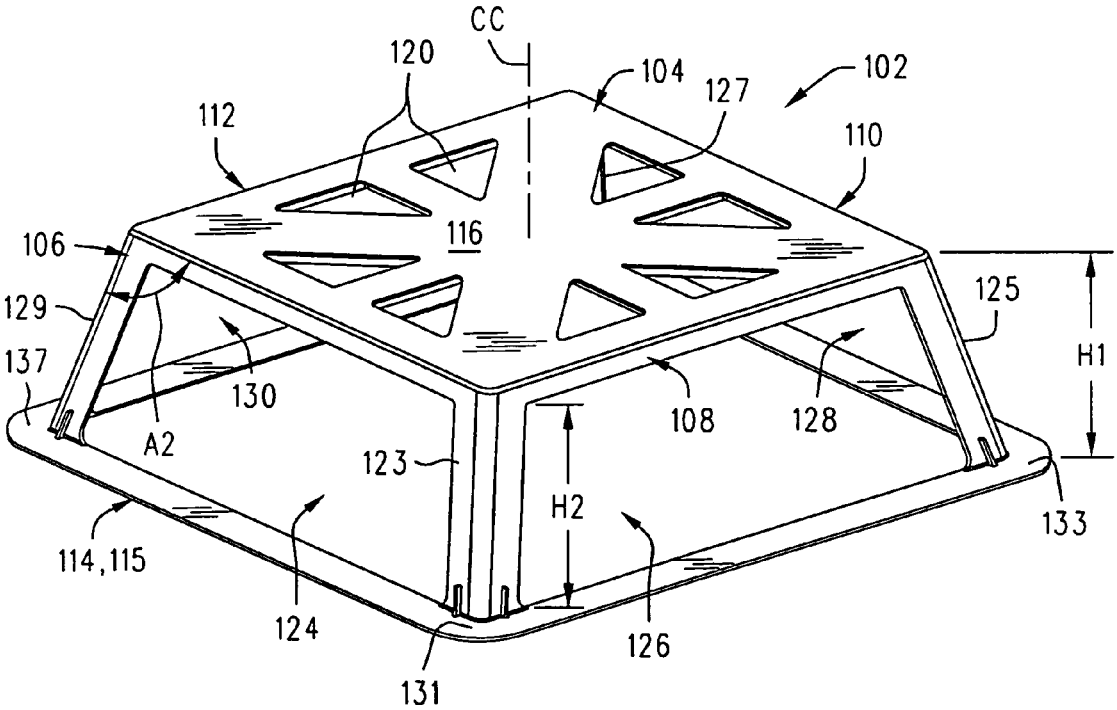
FIG. 4 is another perspective view of the pallet unit of FIG. 3.

As best shown in FIGS. 3–4, each pallet unit 102 may comprise a load support portion 104, a plurality of side portions 106,108, 110, 112, and a flange portion 114. Each pallet unit 102 may be constructed from a disposable/recyclable material such as, for example, high-density polyethylene (HDPE), which is also a relatively inexpensive and readily available material. Thus, after being utilized (stored, shipped, etc.) with a load 50, the pallet system 100 may be disposed of and/or recycled. The term "disposable/recyclable" as used throughout this application is intended to encompass the conventional definitions of both the terms "disposable" and "recyclable", since an end-user of a disposable/recyclable product usually has the option of whether to dispose of or recycle the product. Each pallet unit 102 may be constructed utilizing, for example, plastic injection molding technology.

Referring to FIGS. 3–4, the load support portion 104 of each pallet unit 102 may comprise an upper surface 116 and a lower surface 118. The upper surface 116 is adapted to be placed directly adjacent to (i.e., contacting) the bottom surface 51 of the load 50 as shown in FIG. 2, i.e., with no extraneous materials or binding devices such as adhesive, bands, plastic wrap, etc., being interposed between the bottom surface 51 of the load 50 and the upper surface 116 (FIGS. 3 and 4) of each pallet unit 102. However, it is to be understood that the "bottom surface" 51 of the load 50 may be comprised of some material other than the bottom surface of each of the packages 52. For example, if desired, a non-binding, non-supporting material (such as, for example, cardboard) may be placed between the bottom surface of the packages 52 and the upper surfaces 116 of the load support portions 104.

In order to further minimize the amount of material used as well as the weight of each pallet unit 102, the load support portion 104 may comprise one or more openings 120, FIGS. 3 and 4, extending from the upper surface 116 to the lower surface 118 of the load support portion 104. These openings 120 may be located anywhere on the load support portion 104, but are preferably at locations which, if the load support portion 104 was solid, would receive little or no force from a load 50 (FIG. 2) placed thereon. In order to assist in supporting a load 50 and provide additional strength to the relatively thin load support portion 104, a plurality of ribs 122 (FIG. 3) may be provided which extend from the lower surface 118 of the load support portion 104.

Figure 7:
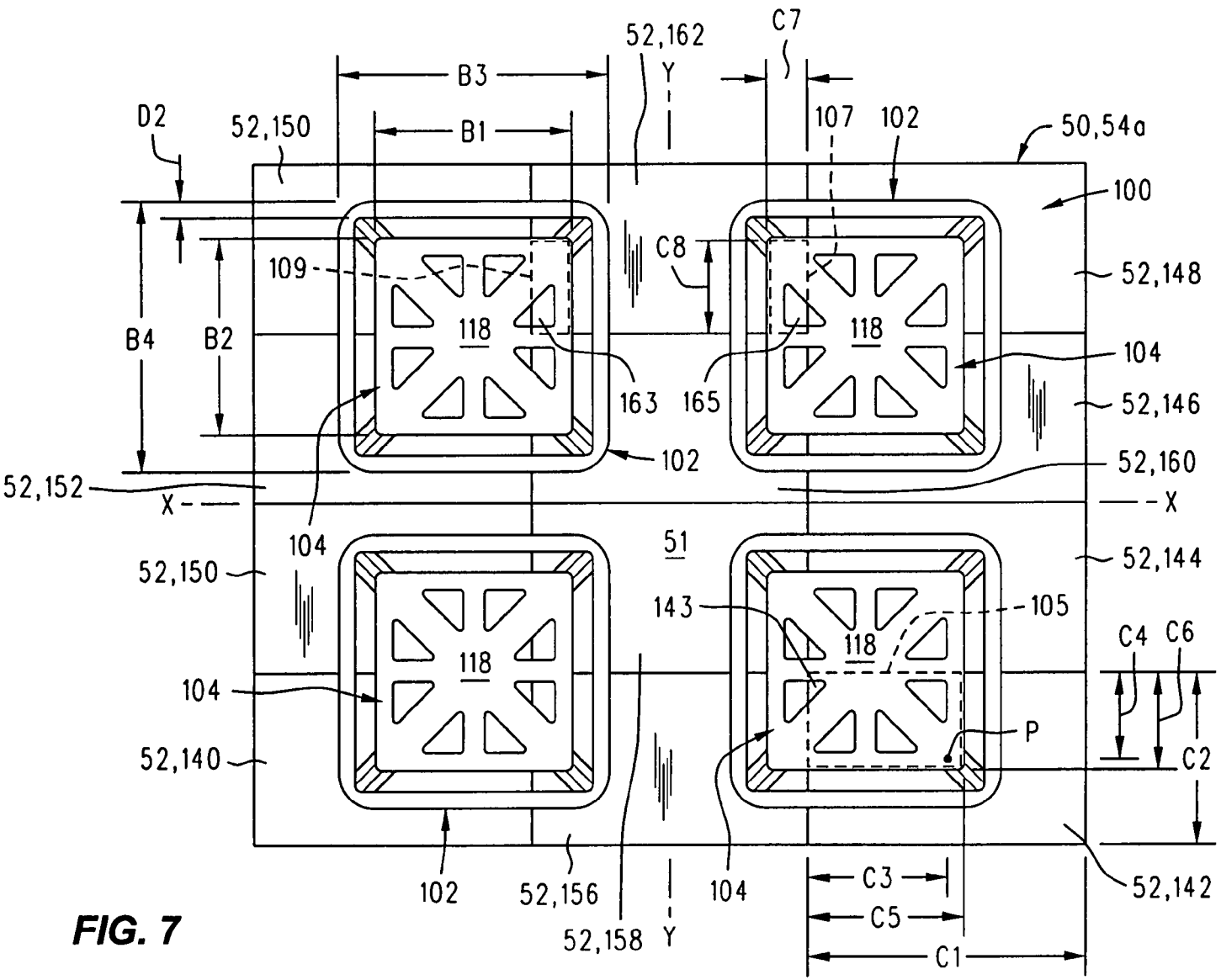
FIG. 7 is a bottom plan view of an embodiment of the pallet system of FIG. 2.
Figure 8:
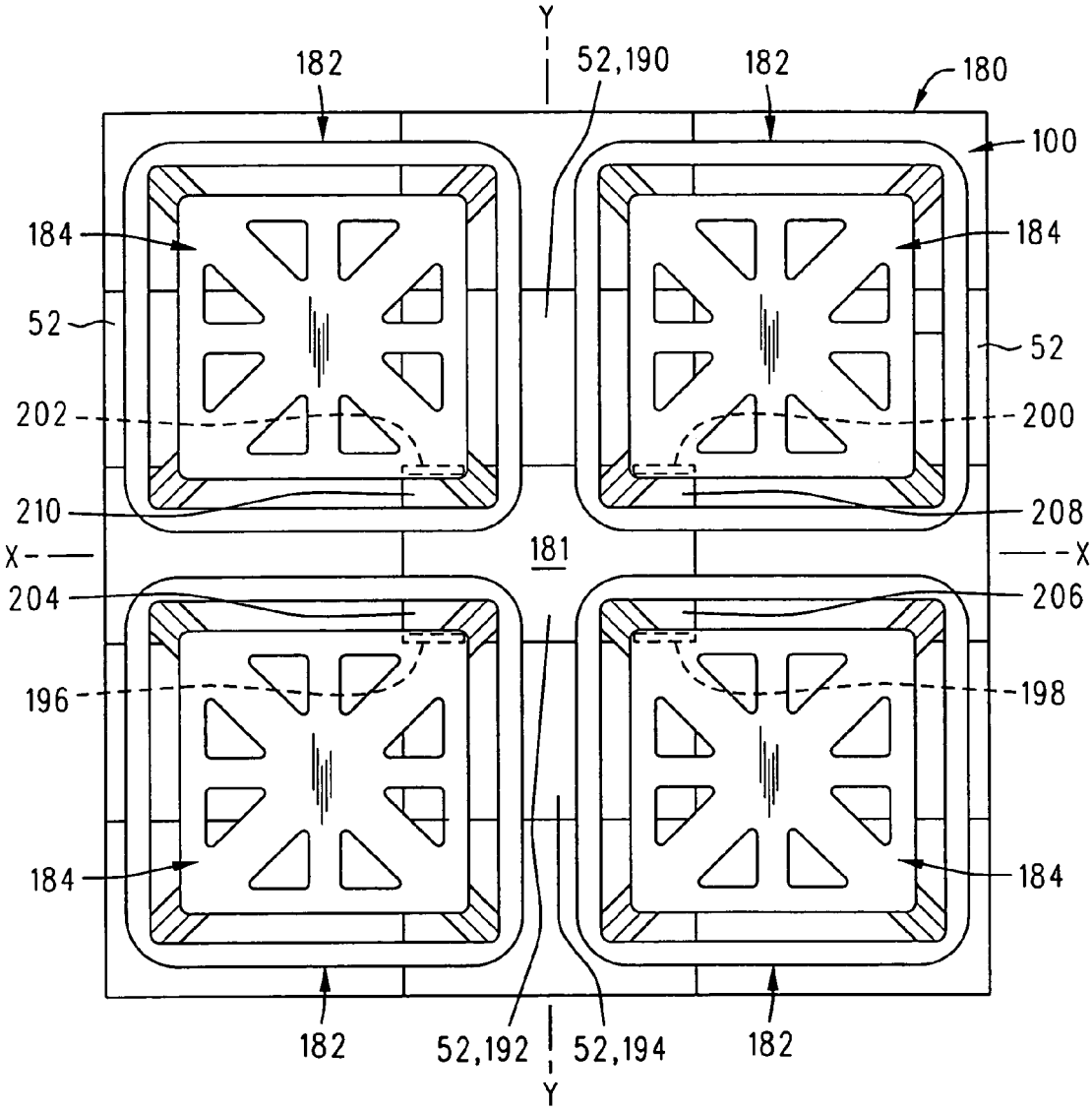
FIG. 8 is a bottom plan view of another embodiment of the pallet system of FIG. 2.

As best shown in FIG. 4, the side portions 106, 108, 110,112 extend from the load support portion 104 at an angle "A2" which is preferably greater than 90 degrees, thus providing added stability since the flange portion 114 is wider than the load support portion 104. Each of the side portions 106, 108,110, 112 may comprise an opening 124, 126, 128, 130, respectively, which is adapted to receive a fork of a forklift (not shown). Each of these openings 124, 126, 128, 130 is preferably relatively large, having a height "H2" (FIG. 4), to minimize the amount of material used as well as the weight of each pallet unit 102, and also to provide a sufficiently-sized opening to allow a fork of a forklift to easily pass therethrough. When multiple pallet units 102 are utilized as shown in FIG. 2, the openings 124, 126, 128, 130 in adjacent pallet units are preferably aligned relative to one another as best shown in FIGS. 7 and 8 to easily receive the forks of a forklift. The height "H1" (FIG. 4) of each pallet unit 102 is also preferably sufficiently sized such that each opening (e.g., 126) may easily receive a fork of a forklift. Each of the openings 124, 126, 128, 130 may extend from the flange 114 almost to the load support portion 104 (i.e., the value of "H2" is relatively large compared to the difference between "H1" and "H2"), thereby forming corner posts 123, 125, 127, 129. To further minimize the amount of material used as well as the weight of each pallet unit 102, and also to provide desired flexibility to at least some portions of each pallet unit 102 (i.e., to the load support portion 104 and the flange portion 114 as discussed below), some or all of the portions 104, 106, 108, 110, 112, 114 are preferably relatively thin. For example, the thicknesses "T1", "T2" (FIG. 5) of the load support portion 104 and flange portion 114, respectively, may each have a relatively small value compared to other dimensions discussed herein such as, for example, "H1" or "H2". While these thicknesses may be relatively consistent (i.e., "T1" may be approximately equal to "T2"), it is to be understood that each of the portions 104, 106, 108, 110, 112, 114 may have varying thicknesses depending on the load distribution among the portions 104, etc., the desired flexibility of each of the portions 104, etc., as well as other factors.

In addition to preferably having relatively thin portions, the pallet unit 102 preferably has a relatively high degree of flexibility such that it is deflectable under the weight of a load 50 (FIG. 2). Such flexibility has a shock-absorbing effect on a load 50 and is a damper to harmonic oscillations, thereby minimizing damage to the packages 52 (FIG. 2) due to vibration and jostling of the load 50 during transportation thereof. In other words, various portions of the pallet unit 102 (in particular, but not limited to, the load support portion 104 and the flange portion 114) may be flexible and deflectable in order to absorb forces applied externally to the load as well as forces from the weight of the load itself.

Figure 5:
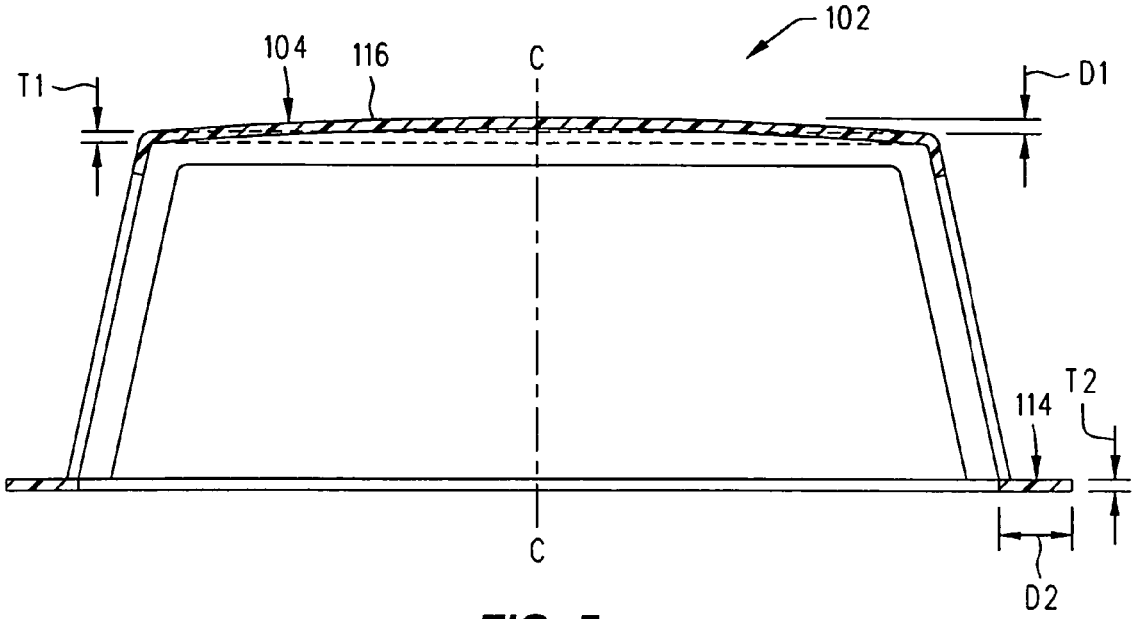
FIG. 5 a cross-sectional view of the pallet unit of FIGS. 3 and 4.

For example, rather than being rigid, the load support portion 104 is preferably flexible and deflectable. The flexibility of the load support portion 104 under the weight of a load is demonstrated in FIG. 5. The solid lines in FIG. 5 represent the load support portion 104 in an unloaded, undeflected state, while the dashed lines represent a possible deflection of the load support portion 104 with an exemplary load (e.g., 50, FIG. 2) placed on the pallet unit 102. In an unloaded state, the load support portion 104 may have a "bowed" cross-sectional shape, i.e., the load support portion 104 may have a curved upper surface 116, whereby the peak or "crown" of the curved surface 116 is located at the central axis "CC", FIGS. 4 and 5. When a load is applied, the load support portion 104 is downwardly deflectable a distance "D1" at axis "CC", FIG. 5, in an attempt "flatten out" against the load. When the load is subjected to external forces (e.g., the load is jostled, loads are stacked on top of one another, etc.), the curved surface 116 allows the load support portion 104 to act as a "spring", and the flexibility of the load support portion 104 is such that it may deflect as needed in order to absorb some or all of the external forces applied thereto. In addition, the curved, flexible surface 116 assists in maintaining the position of the pallet unit 102 against the load so that the pallet unit 102 does not tend to shift or slide out from under the load.

Another flexible, deflectable portion of the pallet unit 102 may be the flange portion 114. As best shown in FIG. 3, the flange portion 114 preferably extends continuously around the entire periphery 115 of the pallet unit 102. The flange portion 114 may extend substantially laterally from the side portions 106, 108, 110, 112 a distance "D2" (FIG. 5). The flange portion 114 may be like a "plastic rope" in that the thickness "T2" (FIG. 5) of the flange portion 114 is preferably relatively thin compared to the distance "D2". Thus, if the flange portion 114 was detached from the side portions 106, 108, 110, 112, and stretched out along its length, the flange portion 114 would, like a rope, be very flexible and not able to support any significant weight. However, since the flange portion 114 is attached to the side portions 106, 108, 110, 112 and extends continuously around the periphery 115 of the pallet unit 102, the flange portion 114 maintains a relatively high degree of flexibility while supporting the weight of a load.

Figure 6:
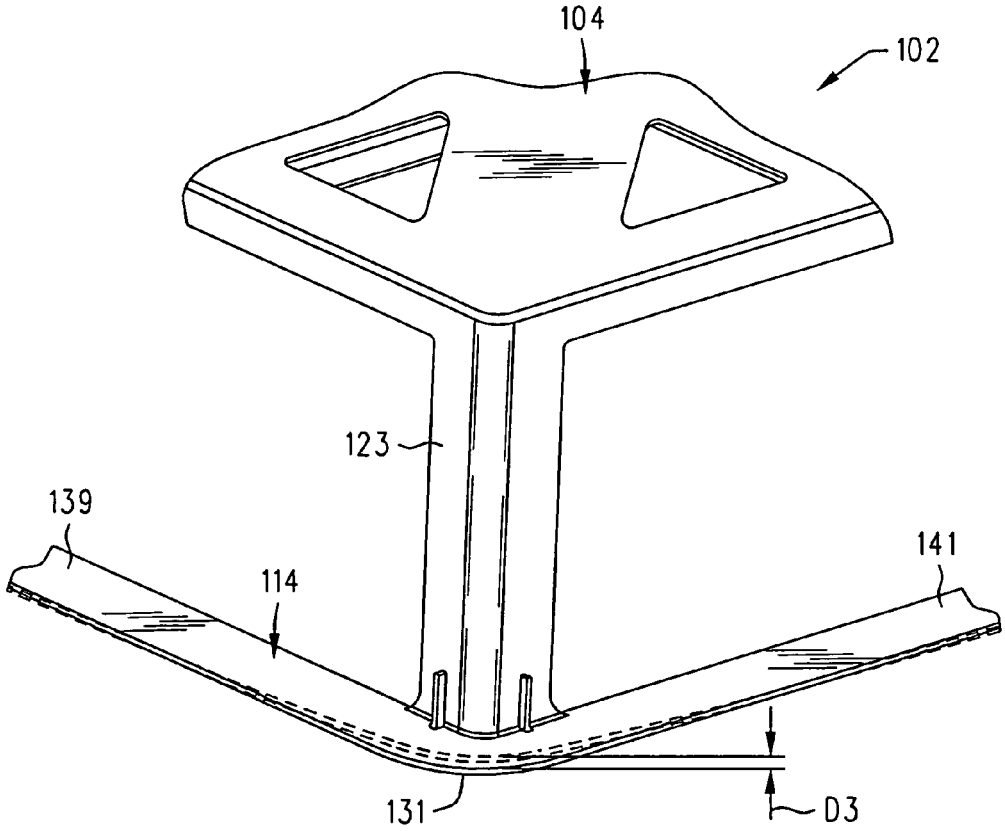
FIG. 6 is an enlarged, partially cutaway, perspective view of the pallet unit of FIG. 4.

The flexibility of the flange portion 114 under the weight of a load is demonstrated in FIG. 6. This figure shows an enlarged, partially cutaway portion of a pallet unit 102 including a corner post 123, a cutaway portion of the load support portion 104, and a cutaway portion of the flange portion 114. The solid lines in FIG. 6 represent the flange portion 114 in an unloaded, undeflected state, while the dashed lines represent a possible deflection of the flange portion 114 with an exemplary load (e.g., 50, FIG. 2) placed on the pallet unit 102. When a load is applied, the flange portion 114 may deflect upwardly a distance "D3" at the corners 131 (FIGS. 4 and 6), 133, 135, 137 (FIGS. 3 and 4) thereof (i.e., where the flange portion 114 is attached at each corner post 123, 125, 127, 129), and the flange portion 114 may deflect slightly downwardly where it is not attached to the side portions (e.g., at 139, 141 in FIG. 6). When the load is subjected to external forces (e.g., the load is jostled, loads are stacked on top of one another, etc.), the flexibility of the flange portion 114 is such that the flange portion 114 may deflect as needed in order to absorb some or all of the external forces.

As illustrated in FIG. 2, each layer 54 of the load 50 may be palletized, i.e., a plurality of packages 52 (which includes any type of container, product, etc.) may be arranged into a desired pattern (typically, but not necessarily having a square or rectangular "footprint"). As illustrated in FIGS. 2 and 7, the lowermost layer 54*a* of the load 50 is preferably palletized in a uniform pattern such that the packages 52 are oriented in the same direction. The layers 54 of a load 50 other than the lowermost layer 54*a* may be randomly palletized, if desired.

FIG. 7 is a bottom plan view of the load 50 and pallet system 100 of FIG. 2 with the ribs 122 (FIG. 3) of each pallet unit 102 removed for clarity. A square or rectangular load support portion 104 (and, in particular, the upper surface 116 thereof) may have surface dimensions of "B1" (measured along an axis parallel to axis "XX") by "B2" (measured along an axis parallel to axis "YY"). As earlier noted, the flange portion 114 may extend substantially laterally from the side portions 106, 108, 110, 112 a distance "D2". The dimensions corresponding to the "footprint" of each of the pallet units 102 is designated in FIG. 7 as "B3" by "B4".

The lowermost layer 54*a* of a load 50 may comprise a plurality of packages 52, including a first type of package 140, 142, 144, 146, 148, 150, 152, 154 (referred to hereinafter as a "one-corner package") which is supported at only one corner thereof (e.g., corner 143 of package 142); and a second type of package 156, 158, 160, 162 (referred to hereinafter as a "two-corner package") which is supported at two opposing corners thereof (e.g., corners 163, 165 of package 162).

As shown in FIG. 7, each of the pallet units 102 are positioned adjacent to the bottom surface 51 of the load 50 such that each of the packages 52 is sufficiently supported without the need for wrapping or binding the packages 52 together in any manner. For example, a substantially rectangular package 52 may have surface dimensions of "C1" (measured along an axis parallel to axis "XX") by "C2" (measured along an axis parallel to axis "YY"). For each of the one-corner packages 140, 142, 144, 146, 148, 150, 152, 154 to be sufficiently supported, the load support portion 104 must be positioned adjacent to a portion of the package indicated in FIG. 7 as "C3" which is at least equal to or preferably greater than ½C1, as well as a portion of the package indicated in FIG. 7 as "C4" which is at least equal to or preferably greater than ½C2. In other words, the center of gravity (designed as "P") of the package 52, 142 must be supported so that the package does not tip over. Thus, as shown in FIG. 7, the load support portion 104 is preferably positioned adjacent to the one-corner packages 140, 142, etc. such that the portion (shown in dashed lines and indicated as reference numeral 105) covering each one-corner package has surface dimensions of "C5" (measured along an axis parallel to axis "XX") by "C6" (measured along an axis parallel to axis "YY"), whereby C5 is equal to or preferably greater than C3 and C6 is equal to or preferably greater than C4. It is to be understood that the values of C4 and C5 may vary for each pallet unit 102 and each load 50, as long as the above parameters are met for C5 and C6.

For two-corner packages 156, 158, 160, 162, only one of the above parameters must be met: i.e., depending on which corners are supported, either C5 must be equal to or preferably greater than C3 or C6 must be equal to or preferably greater than C4. For example, on the two-corner package 162 shown in FIG. 7, the opposing corners 163, 165 are supported. Each of the portions (e.g., 107, 109 in dashed lines) covering each two-corner package has surface dimensions of "C7" (measured along an axis parallel to axis "XX") by "C8" (measured along an axis parallel to axis "YY"). As indicated, the value of C7 at each of the corners 163, 165 may be substantially less than the value of C3, while the value of C8 must be equal to or preferably greater than the value of C4.

While four pallet units 102 are shown in FIGS. 2 and 7, it is to be understood that any number of pallet units 102 may be utilized, depending on the size and configuration of the load 50 and the size of each pallet unit 102. FIG. 8 illustrates an exemplary load 180 comprising a plurality of substantially rectangular packages 52 in a three-by-five (3×5) package configuration rather than the exemplary three-by-four (3×4) package configuration shown in FIG. 7. In order to support the load shown in FIG. 8, pallet units 102 of the type shown in FIG. 7 may be utilized. However, in order to adequately support all of the packages 52, extra pallet units 102 may be utilized. As shown in FIG. 8, however, the same number of relatively larger pallet units 182 may be utilized in order to support all of the packages 52 in a 4×5 package configuration. This exemplary load 180 comprises a plurality of the first and second types of packages (one-corner and two-corner packages) described above, as well as a third type of package 190, 192, 194 (referred to hereinafter as a "four-corner package") which is supported at all four corners thereof. For each of the four-corner packages 190, 192, 194 to be sufficiently supported, each of the load support portions 184 may be positioned adjacent to a relatively small portion (e.g., 196, 198, 200, 202) of each corner (e.g., 204, 206, 208, 210, respectively) of the package (e.g., 192). When a package-190, 192, 194 is supported at all four corners (e.g., 204, 206, 208, 210), the package 190, 192, 194 is not in danger of tipping over. The "beam strength" of the package provides adequate support to a four-corner package 190, 192, 194 even though only a relatively small portion (e.g., 196, 198, 200, 202) of the package (e.g., 192) may be positioned adjacent to a load support portion 184.

The particular characteristics of each of the pallet units 102, 182 in a pallet system 100 may vary according to particular characteristics of the load 50, 180. As an example, a load 50, 180 of packages 52 (which may contain, for example, filled beverage cans) in a three-by-four (3×4) package configuration as shown in FIG. 7 or a three-by-five (3×5) package configuration as shown in FIG. 8 may weigh between approximately 2000 and 3000 lbs. Each substantially rectangular package 52 may have surface dimensions of "C1" by "C2" (FIG. 7), where C1 is approximately 13 inches and C2 is approximately 15 inches. An exemplary pallet system 100 which is strong enough to support the entire load 50, 180 as well as other loads and pallet systems which may be stacked on top of this load may be comprised of four pallet units 102, 182 as shown in FIGS. 7 and 8. Each of the pallet units 102, 182 may have a generally rectangular (and most preferably square) load support portion 104 having surface dimensions of "B1" by "B2" (FIG. 7), where B1 and B2 may each be between about 10 and 12 inches. The thickness "T" (FIG. 4) of the load support portion 104, 184, each of the side portions 106, 108, 110, 112, and the flange portion 114 may be between about 0.05 and 0.1 inch, and most preferably about 0.06 inch. The flange portion 114 may extend from each of the side portions 106, 108, 110, 112 a distance "D2" of between about 1 inch and 3 inches, and most preferably about 2 inches. The dimensions "B3" and "B4" (FIG. 7) may each be between about 12 and 18 inches, and most preferably about 14 inches. Each pallet unit 102, 182 may have a height "H1" (FIG. 4) of between about 4 and 5 inches, and most preferably about 4.5 inches. The angle "A2" (FIG. 4) between each of the side portions 106, 108, 110, 112 and the load support portion 104, 184 may be between about 100 and 110 degrees, and most preferably about 102 degrees. Each of the openings 124, 126, 128, 130 in the side portions 106, 108, 110, 112, respectively, may have a height "H2" of between about 3.5 and 4.25 inches, and most preferably about 4 inches. When an exemplary load of 2000–3000 lbs. is applied to a pallet unit 102, the distance "D1" that the load support portion 104 deflects is preferably between about 0.25 to 0.5 inch. The distance "D3" (FIG. 6) that the flange portion 114 deflects upwardly at the corners thereof (i.e., where the flange portion 114 is attached at each corner post 123) under the exemplary load is preferably between about 0.25 to 0.5 inch. As noted above, each pallet unit 102, 182 may be constructed from a material such as, for example, high-density polyethylene (HPDE), which is a flexible, lightweight, recyclable, relatively inexpensive, and readily available material. However, a pallet unit 102, 182 may be constructed from other materials such as rubber, including materials which have previously been recycled such as prefabricated wood.

As noted above, each of the pallet units 102, 182 are positioned adjacent to the bottom surface 51, 181 of the load 50, 180 (respectively) such that each of the packages 52 is sufficiently supported without the need for wrapping or binding the packages 52 together in any manner. Furthermore, the pallet units 102, 182 need not be adhered to the bottom surface 51, 181 of the load 50, 180 since the weight of the load will typically maintain the position of each pallet unit 102, 182 under the load 50, 180 as it is being lifted by a forklift or the like. Thus, after the forks of a forklift or the like are passed through the openings 124, 126, 128, 130 (FIGS. 3–4) in each pallet unit 102, the forklift may lift both the load 50, 180 and the pallet units 102, 182 without disturbing the position of the pallet units 102, 182 relative to the load 50, 180. However, if desired, the entire load 50, 180 may be wrapped around its circumference with flexible film such as stretch wrap, shrink wrap, or the like in a manner well known in the art in order to laterally secure the load 50, 180.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

I claim:

1. A pallet system for supporting a load of packages comprising a bottom surface, said pallet system comprising a plurality of pallet units, each of said pallet units comprising:

a) a load support portion comprising a flexible curved upper surface and a lower surface, said upper surface being placed directly adjacent to and contacting said bottom surface of said load;

b) a plurality of side portions attached to said load support portion, each of said side portions comprising at least one opening which is sufficiently sized to receive a fork of a forklift; and c) a thin, laterally outwardly extending flange portion attached to said side portions and extending continuously around the periphery of said pallet unit, said flange portion being flexible in order to provide a shock-absorbing effect on said load.

2. The pallet system of claim 1 wherein said load support portion comprises multiple openings extending from said upper surface to said lower surfacer thereof.

3. The pallet system of claim 1 comprising a first pallet unit and a second pallet unit positioned adjacent to said first pallet unit, wherein said opening in at least two of said side portions of said first pallet unit is aligned with said opening in at least two of said side portions of said second pallet unit.

4. The pallet system of claim 1 wherein said flange portion extends substantially laterally a distance from said openings and has a thickness which is relatively thin compared to said distance.

5. The pallet system of claim 1 further comprising a plurality of corner posts formed by said side portions.

6. The pallet system of claim 5, said flange portion comprising a plurality of corners adjacent to said corner posts, said corners being deflectable upwardly when said load is applied to said pallet unit.

7. The pallet system of claim 1 wherein each of said pallet units is constructed from a lightweight, recyclable material.

8. The pallet system of claim 7 wherein said lightweight, recyclable material is high-density polyethylene.

9. A pallet system for supporting a load of packages comprising a bottom surface, said pallet system comprising a plurality of pallet units, comprising:

a) a load support portion comprising a flexible upper surface and a lower surface, said upper surface being curved and at least a portion thereof is placed directly adjacent to and contacts said bottom surface of said load;

b) a plurality of side portions attached to said load support portion, each of said side portions comprising at least one opening which is sufficiently sized to receive a fork of a forklift, said side portions forming a plurality of corner posts;

c) a thin, laterally outwardly extending flange portion attached to said side portions and comprising a plurality of corners adjacent to said corner posts, said flange portion extending continuously around the periphery of said pallet unit and extending substantially laterally a distance from said openings, said flange portion having a thickness which is relatively thin compared to said distance, and said flange portion being flexible in order to provide a shock-absorbing effect on said load wherein said corners are deflectable upwardly when said load is applied to said pallet unit; and d) wherein each of said pallet units is constructed from a lightweight, recyclable material.

10. A method for supporting a load of packages comprising a bottom surface, said method comprising:

a) aligning a plurality of pallet units relative to one another, each of said pallet units comprising:

i) a load support portion comprising a flexible curved upper surface and a lower surface;

ii) a plurality of side portions attached to said load support portion, each of said side portions comprising at least one opening which is sufficiently sized to receive a fork of a forklift, said aligning a plurality of pallet units comprising aligning at least a first one of said side portions of a first one of said pallet units with at least a second one of said side portions of a second one of said pallet units, said first one of said pallet units and said second one of said pallet units being positioned adjacent to one another; and iii) a thin, laterally outwardly extending flange portion attached to said side portions and extending continuously around the periphery of said pallet unit, said flange portion being flexible in order to provide a shock-absorbing effect on said load; and b) placing a plurality of said packages directly adjacent to said upper surface of said load support portion of said pallet units to form said load such that said upper surface of said load support portion contacts said bottom surface of said load.

11. The method of claim 10, each of said packages having a first surface dimension and a second surface dimension, said load of packages further comprising a first type of package which is supported by at least one of said load support portions at one corner thereof and a second type of package which is supported by at least two of said load support portions at opposing corners thereof;

wherein the step of placing a plurality of said packages directly adjacent to said upper surface of said load support portion further comprising:

aligning said plurality of packages on said upper surface of said load support portion such that at least one of said load support portions is positioned adjacent to at least half of said first surface dimension and at least half of said second surface dimension of each of said first type of packages, and at least one of said load support portions is positioned adjacent to at least half of said first surface dimension of each of said second type of packages.

12. A pallet system for supporting a load of packages, comprising:

a) said load of packages comprising multiple layers of packages and a bottom surface; and b) a plurality of pallet units, each of said pallet units comprising:

i) a load support portion comprising a flexible curved upper surface and a lower surface, said upper surface being placed directly adjacent to and contacting said bottom surface of said load;

ii) a plurality of side portions attached to said load support portion, each of said side portions comprising at least one opening which is sufficiently sized to receive a fork of a forklift; and iii) a thin, laterally outwardly extending flange portion attached to said side portions and extending continuously around the periphery of said pallet unit, said flange portion being flexible in order to provide a shock-absorbing effect on said load.

13. The pallet system of claim 12, wherein said bottom surface of each of said packages in said lowermost layer is positioned directly adjacent to said load support portion of at least one of said pallet units.

14. The pallet system of claim 12, each of said packages having a first surface dimension and a second surface dimension, said load of packages further comprising a first type of package which is supported by at least one of said load support portions at one corner thereof and a second type of package which is supported by at least two of said load support portions at opposing corners thereof, at least one of said load support portions being positioned adjacent to at least half of said first surface dimension and at least half of said second surface dimension of each of said first type of packages, and at least one of said load support portions being positioned adjacent to at least half of said first surface dimension of each of said second type of packages.

* * * * *